US006159919A

United States Patent [19]

Yamaguchi et al.

[11] Patent Number: 6,159,919

[45] **Date of Patent: *Dec. 12, 2000**

[54] BLEACHING DETERGENT COMPOSITION

[75] Inventors: Shu Yamaguchi; Nobuyosi Yamaguchi; Muneo Aoyagi; Noriaki Ushio; Shigeru Tamura; Masaki Tsumadori, all of Wakayama, Japan

[73] Assignee: Kao Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/633,698

[22] Filed: Apr. 19, 1996

[30] Foreign Application Priority Data

Apr. 20, 1995 [JP] Japan ..... 7-120533

[51] Int. Cl.[7] ..... C11D 3/395

[52] U.S. Cl. ..... 510/312; 510/309; 510/356; 510/375; 510/376; 252/186.38; 252/186.41

[58] Field of Search ..... 252/186.38, 186.41; 510/309, 312, 315, 318, 375, 376, 377, 466, 356

[56] References Cited

U.S. PATENT DOCUMENTS

| | | | |
|---|---|---|---|
| 4,412,934 | 11/1983 | Chung et al. | 252/186.38 |
| 5,427,711 | 6/1995 | Sakaguchi et al. | 510/376 |
| 5,454,982 | 10/1995 | Murch et al. | 510/321 |
| 5,500,153 | 3/1996 | Figueroa et al. | 510/321 |
| 5,534,197 | 7/1996 | Scheibel et al. | 510/356 |
| 5,561,235 | 10/1996 | Gosselink et al. | 510/308 |
| 5,584,888 | 12/1996 | Miracle et al. | 510/305 |
| 5,595,967 | 1/1997 | Miracle et al. | 510/303 |

FOREIGN PATENT DOCUMENTS

| | | |
|---|---|---|
| 337217A2 | 10/1989 | European Pat. Off. . |
| 550048A1 | 7/1993 | European Pat. Off. . |
| 639639 | 2/1995 | European Pat. Off. . |
| 9022999 | 2/1984 | Japan . |
| 6116591 | 4/1994 | Japan . |
| 6316700 | 11/1994 | Japan . |
| 7053992 | 2/1995 | Japan . |
| 9203525 | 3/1992 | WIPO . |
| 9206151 | 4/1992 | WIPO . |
| 9403554 | 2/1994 | WIPO . |
| 9424238 | 10/1994 | WIPO . |
| 95/02682 | 1/1995 | WIPO . |
| 9502682 | 1/1995 | WIPO . |

*Primary Examiner*—Caroline D. Liott
*Attorney, Agent, or Firm*—Birch, Stewart, Kolasch & Birch, LLP

[57] ABSTRACT

The bleaching detergent composition in a form of granules or powders containing an organic peracid precursor which produces an organic peracid upon reaction with hydrogen peroxide in water, the organic peracid having an alkyl group with 7 to 19 carbon atoms, and a hydrogen peroxide releasing material, wherein the bleaching detergent composition comprises the following components a) to c): a) one or more surfactants; b) one or more crystalline alkali metal silicates; and c) one or more agents for capturing metal ions other than the crystalline alkali metal silicates b), wherein a total amount of the above a), b), and c) components in the bleaching detergent composition occupies from 70 to 99% by weight, and wherein the weight ratio of component b) to component a) is b/a=90/10 to 45/55, and the weight ratio of component b) to component c) is b/c=7/93 to 75/25, and wherein the weight ratio of the organic peracid precursor to nonionic surfactants used as component a) is from 10/90 to 70/30.

13 Claims, 1 Drawing Sheet

BLEACHING DETERGENT COMPOSITION

BACKGROUND OF THE INVENTION

1. Field of the Invention

The present invention relates to a bleaching detergent composition showing excellent performance for both the detergency against sebum dirt stains and that against lipophilic dirt stains, such as yellowish stains of underwear. In the present invention, the term "yellowish stains" used herein refers to a color change of white underwears to yellowish color by deposition and accumulation of excreta.

2. Discussion of the Related Art

Conventionally, various proposals have been made to improve detergency against yellowish stains caused by detergent compositions by formulating bleaching agent components to the detergent compositions.

For example, Japanese Patent Laid-Open Nos. 59-22999 and 6-316700 disclose bleaching agent compositions and bleaching detergent compositions, each containing an organic peracid precursor which produces an organic peracid having an alkyl group with a particular number of carbon atoms, and a hydrogen peroxide releasing material. The organic peracids produced from the organic peracid precursors mentioned above show remarkably excellent bleaching power against dirt stains, but in cases where the organic peracid precursors are added to ordinary detergent compositions to make bleaching detergent compositions, sufficiently good bleaching effects cannot be obtained. The reasons therefor are presumably as follows: Since the surfactant concentration, particularly a nonionic surfactant concentration, is very high in these detergent compositions, the organic peracid precursors are enclosed in the surfactant micelle and dissolved therein. Therefore, the reaction of the organic peracid precursors with the hydrogen peroxide releasing material is notably inhibited, thereby preventing the generation of organic peracids, which are bleaching species. Higher the proportion of the nonionic surfactants in the surfactant components, more notable the inhibition of the reaction of the organic peracid precursors with the hydrogen peroxide releasing material becomes. For the reasons given above, the formulation of the nonionic surfactants in an effective amount has been difficult, when compared with anionic surfactants, thereby making it impossible to satisfy both the detergency against the sebum dirt stains and the detergency against the yellowish stains of underwear.

On the other hand, the present inventors have found that a high detergency can be performed against the sebum dirt stains even when the concentration of the surfactant used is notably reduced by using a crystalline alkali metal silicate having an alkaline capacity in a high concentration and improving metal ion capturing ability. However, in this washing method, a sufficient washing performance against the lipophilic dirt stains, such as yellowish dirt stains on underwear, cannot be achieved.

Examples of detergent compositions where a crystalline silicate and a bleaching component are essential components include Japanese Patent Laid-Open Nos. 6-116591 and 7-53992. The above publications pertains to bleaching detergents comprising sodium crystalline silicates, surfactants, and bleaching components comprising bleaching activating agents which produce peroxy fatty acids and sodium percarbonate. The bleaching detergents having compositions disclosed in these references have insufficient detergency against the sebum dirt stains. In addition, since the compositional ratio of the surfactants are high, the composition does not allow to effectively produce organic peracids by the bleaching activating agents (organic peracid precursors). Therefore, sufficient effects in removing lipophilic dirt stains, such as yellowish dirt stains on underwear, cannot be obtained.

SUMMARY OF THE INVENTION

Accordingly, it is an object of the present invention to provide a bleaching detergent composition which are in the form of granules or powders showing excellent performance for both the detergency against the sebum dirt stains and the detergency against the lipophilic dirt stains, such as yellowish stains of underwear.

As a result of intensive investigation in view of the above problems, the present inventors have found that by limiting the compositional proportions of the surfactants, the crystalline alkali metal silicates, and the agents for capturing metal ions other than crystalline alkali metal silicates to particular ranges, and by limiting the amounts of the organic peracid precursor based on the nonionic surfactants to a particular range, the bleaching detergent composition have excellent detergency performance not only against the lipophilic dirt stains, such as yellowish stains on underwear but also against the sebum dirt stains, while the resulting bleaching detergent compositions can effectively enjoy good bleaching activity owned by the organic peracid precursors which produce organic peracids each having alkyl groups having about 7 to 19 carbon atoms.

More specifically, a bleaching activating agent which produces a peroxy fatty acid having an alkyl group with 7 or more carbon atoms gives excellent detergency against the yellowish stains on underwear, etc. as well as excellent detergency against the sebum dirt stains. However, in general, when a large amount of nonionic surfactants are formulated as mentioned above, the reaction of the bleaching activating agent with hydrogen peroxide in an aqueous solution is inhibited, which leads to a phenomenon wherein the generation of the organic peracids are undesirably suppressed. For the reasons given above, although the bleaching activating agents mentioned above have been conventionally considered to be unsuitable for use in nonionic surfactant-based detergent compositions, the present inventors have found that by selecting a particular compositional ratio of the components, unexpected results in detergency and bleaching power can be achieved. The present invention has been found based on these findings.

On the other hand, the prior art references given above discloses detergent compositions comprising anionic surfactants as the main surfactant component. These references do not achieve the detergency in the present invention. This is clearly illustrated in Examples of the present invention, where the bleaching detergent compositions of the present invention are shown in comparison with comparative examples which are obtained from the prior art references cited above.

Specifically, the present invention is concerned with the following:

(1) A bleaching detergent composition in a form of granules or powders containing an organic peracid precursor which produces an organic peracid upon reaction with hydrogen peroxide in water, the organic peracid having an alkyl group with 7 to 19 carbon atoms, and a hydrogen peroxide releasing material, wherein the bleaching detergent composition comprises the following components a) to c):

a) one or more surfactants;

b) one or more crystalline alkali metal silicates; and c) one or more agents for capturing metal ions other than the crystalline alkali metal silicates b), wherein a total amount of the above a), b), and c) components in the bleaching detergent composition occupies from 70 to 99% by weight, and wherein the weight ratio of component b) to component a) is b/a=90/10 to 45/55, and the weight ratio of component b) to component c) is b/c=7/93 to 75/25, and wherein the weight ratio of the organic peracid precursor to nonionic surfactants used as component a) is from 10/90 to 70/30;

(2) The bleaching detergent composition described in item (1) above, wherein the amount of one or more nonionic surfactants occupies 50 to 100% by weight of the entire surfactant component a);

(3) The bleaching detergent composition described in item (1) or item (2) above, wherein the organic peracid produced is a peroxy fatty acid having a linear alkyl group with 7 to 19 carbon atoms;

(4) The bleaching detergent composition described in item (3) above, wherein the organic peracid precursor has the general formula (I):

(I)

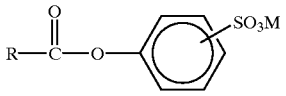

wherein R stands for a linear alkyl group or linear alkylene group, each having 7 to 19 carbon atoms; and M stands for an alkali metal atom;

(5) The bleaching detergent composition described in any one of items (1) to (4) above, wherein the component a) is a polyoxyethylene alkyl ether which is an ethylene oxide adduct of a linear alcohol having 10 to 18 carbon atoms, the ethylene oxide adduct having an average molar amount of 5 to 15;

(6) The bleaching detergent composition described in any one of items (1) to (5) above, wherein the crystalline alkali metal silicates have an $SiO_2/M_2O$ ratio of from 0.5 to 2.6, wherein M stands for an alkali metal atom;

(7) The bleaching detergent composition described in item (6) above, wherein the crystalline alkali metal silicates have the general formula (II):

$$xM_2O \cdot ySiO_2 \cdot zMe_mO_n \cdot wH_2O, \quad \text{(II)}$$

wherein M stands for one or more elements in Ia Group of the Periodic Table; Me stands for one or more elements in Group IIa, Ilb, IIIa, IVa, or VIII of the Periodic Table, and wherein x, y, z, n, m, and w are numerical values satisfying the following relationships: y/x=0.5 to 2.6, z/x=0.01 to 1.0, n/m=0.5 to 2.0, and w=0 to 20;

(8) The bleaching detergent composition described in item (6) above, wherein the crystalline alkali metal silicates have the general formula (III):

$$M_2O \cdot x'SiO_2 \cdot y'H_2O, \quad \text{(III)}$$

wherein M stands for an alkali metal atom, and x' and y' are numerical values satisfying x'=1.5 to 2.6 and y'=0 to 20;

(9) The bleaching detergent composition described in any one of items (1) to (8) above, wherein the amount of the crystalline alkali metal silicates is from 20 to 50% by weight;

(10) The bleaching detergent composition described in any one of items (1) to (9) above, wherein the hydrogen peroxide releasing material is in the form of granules or powders having an effective oxygen concentration of from 5 to 15% by weight, and wherein the hydrogen peroxide releasing material is contained in the bleaching detergent composition in an amount of 0.5 to 15% by weight;

(11) The bleaching detergent composition described in any one of items (1) to (10) above, wherein the hydrogen peroxide releasing material is sodium percarbonate; and

(12) The bleaching detergent composition described in any one of items (1) to (11) above, wherein the surfactant concentration is from 0.07 to 0.17 g/L when the bleaching detergent composition is added to water for washing in a standard amount of dosage.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
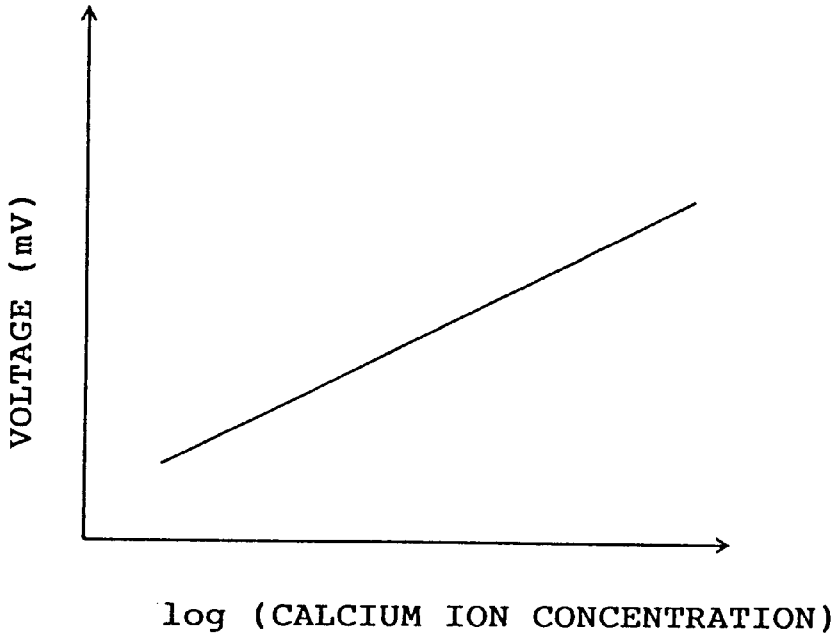
FIG. 1 is a graph showing a calibration curve of the relationship between the logarithm of the calcium ion concentration and the voltage.

The bleaching detergent composition of the present invention is in the form of granules or powders and contains an organic peracid precursor which produces an organic peracid having an alkyl group with 7 to 19 carbon atoms upon reaction with hydrogen peroxide in water, and a hydrogen peroxide releasing material.

Examples of the organic peracid precursors which produces an organic peracid with hydrogen peroxide in water include alkanoyloxybenzenesulfonates, alkanoyloxybenzoates, and N,N,N',N'-tetraacetylethylenediamine. Among them, a preference is given to alkanoyloxybenzenesulfonates having the general formula (I) because their excellent storage stability and bleaching performance.

(I)

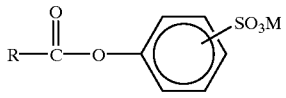

wherein R stands for a linear alkyl group or linear alkylene group, each having 7 to 19 carbon atoms; and M stands for an alkali metal atom.

In the general formula (I), examples of R include a heptyl group, an octyl group, a decyl group, an undecyl group, a dodecyl group, a tridecyl group, and a nonadecyl group, with a preference given to the undecyl group and the dodecyl group.

Examples of M include a sodium atom and a potassium atom, with a preference given to the sodium atom.

Incidentally, the above alkanoyloxybenzenesulfonates having the general formula (I) may take any of ortho-, meta-, and para-forms, with a preference given to those mainly comprising para-forms.

The proportion of the organic peracid precursors mentioned above to the nonionic surfactants is, by weight ratio, 10/90 to 70/30, preferably 15/85 to 50/50. When the proportion of the organic peracid precursor is smaller than the lower limit of the above range, the proportion of the surfactant becomes too large, thereby making it impossible to produce a sufficient amount of bleaching activating agents (organic peracids) in the resulting composition, so that sufficient detergency against the yellowish stains on underwear cannot be obtained. On the other hand, when the proportion of the organic peracid precursors is larger than the upper limit of the above range, the relative proportion of the surfactant becomes small, thereby making it likely to lower the detergency against the sebum dirt stains.

Incidentally, the above organic peracid precursors may be produced by any known methods, including, for instance, a method comprising treating a phenolsulfonate with an acid chloride having a corresponding number of carbon atoms.

The usable hydrogen peroxide releasing materials include percarbonates, perborates, perphosphates, and persilicates, each of which is in the form of granules or powders, with a preference given to percarbonates, particularly sodium percarbonate. The hydrogen peroxide releasing material has an effective oxygen concentration of preferably from 5 to 15% by weight, more preferably from 7 to 13% by weight, which is in the form of granules or powders. The amount of the hydrogen peroxide releasing materials in the bleaching detergent composition is preferably from 0.5 to 15% by weight, more preferably from 1 to 10% by weight, most preferably from 2 to 7% by weight.

In the present invention, the above organic peracid precursor is treated with the hydrogen peroxide releasing material to produce an organic peracid. The organic peracids produced thereby include peroxy fatty acids, with a preference given to the peroxy fatty acids each having a linear alkyl group with 7 to 19 carbon atoms, particularly 8 to 14 carbon atoms. When the linear alkyl group has less than 7 carbon atoms, the detergency against the yellowish stains on underwear and that against the sebum dirt stains are likely to be lowered. On the other hand, when the linear alkyl group has more than 19 carbon atoms, the peroxy fatty acid has poor solubility in water is poor, thereby making it difficult to use for practical purposes.

The bleaching detergent composition of the present invention contains, other than the components mentioned above, the following components a)–c): a) one or more surfactants; b) one or more crystalline alkali metal silicates; and c) one or more agents for capturing metal ions other than the crystalline alkali metal silicates b).

The amounts and the weight ratios of the above components a), b), and c) are as follows.

Specifically, the total amount of the above a), b), and c) components in the bleaching detergent composition is from 70 to 99% by weight, preferably from 80 to 96% by weight. When the total amount is smaller than the lower limit of the above range, sufficient detergency effects cannot be obtained.

The proportion of the b) component to the a) component, i.e. b)/a), is, by weight ratio, from 90/10 to 45/55, preferably form 80/20 to 50/50. When the proportion of the b) component is less than the lower limit of the above range, the production of the organic peracid is suppressed and the detergency against the sebum dirt stains is likely to be lowered. When the proportion of the b) component is more than the upper limit of the above range, the effects of the present invention are not likely to be sufficiently obtained.

The proportion of the b) component to the c) component, i.e. b)/c), is, by weight ratio, 7/93 to 75/25, preferably 15/85 to 65/35. When the proportion of the b) component is outside the above range, sufficient effects of the present invention are not likely to be obtained.

A low surfactant concentration can be achieved by lowering the detergent concentrations in washing liquid. The detergent concentration is determined by the standard amount of dosage of the detergents. The detergent concentration normally depends upon the water hardness of the water for washing used, because the amount of the metal ion capturing agent needs to be adjusted according to the water hardness of the water used for washing.

The standard amount of dosage of the detergents greatly differs throughout the world. This is due to the differences in the water hardness of tap water in each of the countries. For instance, while the tap water has a water hardness of usually around 4° DH in Japan, the tap water having a water hardness of not less than 6° DH in the U.S., and that exceeding 10° DH in European countries is used for the water for washing. Therefore, since the required absolute amount of the metal ion capturing agent varies, the standard amount of dosage would be adjusted accordingly. In the present invention, although the amount of the metal ion capturing agent varies depending upon the water hardness, the surfactant concentration in the washing liquid remains substantially the same, and the standard amount of dosage becomes smaller than the conventional ones.

Specifically, in cases where the initial water hardness differs in each of the washing liquids, the detergent concentrations are as follows:

1) As for the water for washing having a water hardness of 2 to 6° DH, the detergent composition has a concentration in the washing liquid of from 0.33 to 0.67 g/L, preferably from 0.33 to 0.50 g/L.
2) As for the water for washing having a water hardness of 6 to 10° DH, the detergent composition has a concentration in the washing liquid of from 0.50 to 1.20 g/L, preferably from 0.50 to 1.00 g/L.
3) As for the water for washing having a water hardness of 10 to 20° DH, the detergent composition has a concentration in the washing liquid of from 0.80 to 2.50 g/L, preferably from 1.00 to 2.00 g/L.

In the present invention, when the detergent concentration is determined by the standard amount of dosage of the detergents mentioned above, excellent detergency can be achieved even when the surfactant is contained at a low concentration of, for instance, from 0.07 to 0.17 g/L, particularly from 0.08 to 0.14 g/L.

a) Surfactants

The surfactants usable in the present invention are not particularly limited, and any of those generally used for detergents may be employed. Among them, a preference is given to surfactants comprising one or more nonionic surfactants in an amount of 50 to 100% by weight, particularly 70 to 100% by weight.

Specifically, they may be one or more surfactants selected from the group consisting of nonionic surfactants, anionic surfactants, cationic surfactants and amphoteric surfactants as exemplified below. For instance, the surfactants can be chosen such that the surfactants of the same kind are chosen, as in the case where a plurality of nonionic surfactants are chosen. Alternatively, the surfactants of the different kinds are chosen, as in the case where an anionic surfactant and a nonionic surfactant are respectively chosen.

Examples of the nonionic surfactants include polyoxyethylene alkyl ethers, polyoxyethylene alkylphenyl ethers, polyoxyethylene sorbitan fatty acid esters, polyoxyethylene sorbitol fatty acid esters, polyethylene glycol fatty acid esters, polyoxyethylene polyoxypropylene alkyl ethers, polyoxyethylene castor oils, polyoxyethylene alkylamines, glycerol fatty acid esters, higher fatty acid alkanolamides, alkylglycosides, and alkylamine oxides.

Among the nonionic surfactants, a preference is given to polyoxyethylene alkyl ethers which are ethylene oxide adducts of linear alcohols each having 10 to 18 carbon atoms, the ethylene oxide adducts having an average molar amount of 5 to 15, because of their high detergency against the sebum dirt stains.

The anionic surfactants used for the detergent composition include alkylbenzenesulfonates, alkyl or alkenyl ether sulfates, alkyl or alkenyl sulfates, α-olefinsulfonates, α-sulfofatty acid salts, ester salts of α-sulfofatty acids, alkyl or alkenyl ether carboxylates, amino acid-type surfactants, N-acyl amino acid-type surfactants, with a preference given to alkylbenzenesulfonates, alkyl or alkenyl ether sulfates, and alkyl or alkenyl sulfates.

Examples of the cationic surfactants include quaternary ammonium salts, such as alkyltrimethylamine salts. Examples of the amphoteric surfactants include carboxy-type and sulfobetaine-type amphoteric surfactants.

b) Crystalline Alkali Metal Silicates

The crystalline alkali metal silicates usable in the present invention include alkali metal silicates having various compositions, with a preference given to the alkali metal silicates having an $SiO_2/M_2O$ ratio (wherein M stands for an alkali metal atom) of from 0.5 to 2.6. When the $SiO_2/M_2O$ ratio exceeds 2.6, the detergency against the sebum dirt stains is likely to be lowered, and the production efficiency of the organic peracids is likely to be lowered. On the other hand, when the $SiO_2/M_2O$ ratio is less than 0.5, the powder properties when used as powdery or granular detergents are lowered.

Incidentally, in the present invention, the use of the crystalline alkali metal silicates gives good ion exchange capacity as well as high alkaline capacity.

Among the crystalline alkali metal silicates usable in the present invention, a preference is given to those having one of the following compositions:

$$(1)\ xM_2O \cdot ySiO_2 \cdot zMe_mO_n \cdot wH_2O, \qquad \text{(II)}$$

wherein M stands for one or more elements in Ia Group of the Periodic Table; Me stands for one or more elements in Group IIa, IIb, IIIa, IVa, or VIII of the Periodic Table, and wherein x, y, z, n, m, and w are numerical values satisfying the following relationships: y/x=0.5 to 2.6, z/x=0.01 to 1.0, n/m=0.5 to 2.0, and w=0 to 20.

$$(2)\ M_2O \cdot x'SiO_2 \cdot y'H_2O, \qquad \text{(III)}$$

wherein M stands for an alkali metal atom, and x' and y' are numerical values satisfying x'=1.5 to 2.6 and y'=0 to 20.

First, the crystalline alkali metal silicates having the composition (1) above will be explained below.

In the general formula (II), M stands for one or more elements in Ia Group of the Periodic Table, and examples of the Ia Group elements include Na and K. These elements may be used alone or in combination, including a case where $M_2O$ component is constituted by a mixture of $Na_2O$ and $K_2O$.

Me stands for one or more elements in Group IIa, IIb, IIIa, IVa, or VIII of the Periodic Table, and examples thereof include Mg, Ca, Zn, Y, Ti, Zr, and Fe, without being particularly limited thereto. From the viewpoints of resource availability and safety, a preference is given to Mg and Ca. In addition, these elements may be used alone or in combination of two or more kinds. For instance, MgO and CaO may be mixed to constitute an $Me_mO_n$ component.

In addition, the crystalline alkali metal silicates having the general formula (II) in the present invention may be a hydrate, wherein the degree of hydration is normally 0 to 20 moles of $H_2O$ in the above general formula.

With respect to the general formula (II), y/x is 0.5 to 2.6, preferably 1.5 to 2.2. When y/x is less than 0.5, the crystalline alkali metal silicates have insufficient anti-solubility in water, thereby notably giving undesirably poor effects in caking ability, solubility, and powder properties of the detergent composition. On the other hand, when y/x exceeds 2.6, the crystalline alkali metal silicates have a low alkaline capacity, making it insufficient to be used as an alkalizer, and also has a low ion exchange capacity, making it insufficient to be used as an inorganic ion exchange material. With respect to z/x, it is 0.01 to 1.0, preferably 0.02 to 0.9. When z/x is less than 0.01, the crystalline alkali metal silicates have insufficient anti-solubility in water, and when z/x exceeds 1.0, the crystalline alkali metal silicates have a low ion exchange capacity, making it insufficient to be used as an inorganic ion exchange material. With respect to x, y and z, there are no limitations, provided that y/x and z/x have the above relationships. When $xM_2O$, for example, is $x'Na_2O \cdot x''K_2O$ as described above, x equals to x'+x''. Likewise can be said for "z" when the $zMe_mO_n$ component comprises two or more kinds. Further, the phrase "n/m is from 0.5 to 2.0" indicates the number of oxygen ions coordinated to the above elements, which actually takes values selected from 0.5, 1.0, 1.5, and 2.0.

The crystalline alkali metal silicate in the present invention comprises three components, $M_2O$, $SiO_2$, and $Me_mO_n$, as indicated by the general formula (II) above. Materials which can be converted to each of these components, therefore, is indispensable for starting materials for producing the crystalline alkali metal silicate in the present invention. In the present invention, known compounds can be suitably used for starting materials without limitations. Examples of the starting materials for the $M_2O$ component and the $Me_mO_n$ component include simple or complex oxides, hydroxides and salts of respective elements; and minerals containing respective elements. Specifically, examples of the starting materials for the $M_2O$ component include NaOH, KOH, $Na_2CO_3$, $K_2CO_3$, and $Na_2SO_4$. Examples of the starting materials for the $Me_mO_n$ component include $CaCO_3$, $MgCO_3$, $Ca(OH)_2$, $Mg(OH)_2$, MgO, $ZrO_2$, and dolomite. Examples of the starting materials for the $SiO_2$ component include silica sand, kaolin, talc, fused silica, and sodium silicate.

In the present invention, a method of producing the crystalline alkali metal silicate may be exemplified by blending these starting material components to provide the desired compositions in x, y, and z for the crystalline alkali metal silicate, and baking the resulting mixture at a temperature in the range of normally from 300 to 1500° C., preferably from 500 to 1000° C., more preferably from 600 to 900° C., to form crystals. In this case, when the heating temperature is less than 300° C., the crystallization is insufficient, thereby making the anti-solubility in water of the resulting crystalline alkali metal silicate poor, and when it exceeds 1500° C., coarse grains are likely to be formed, thereby decreasing the ion exchange capacity of the resulting crystalline alkali metal silicate. The heating time is normally 0.1 to 24 hours. Such baking can normally be carried out in a heating furnace such as an electric furnace or a gas furnace.

The crystalline alkali metal silicate in the present invention thus obtained has a pH of not less than 11 in a 0.1% by weight dispersion solution, showing an excellent alkaline capacity. Also, the crystalline alkali metal silicate particularly excels in their alkaline buffering effects, having excellent alkaline buffering effects when compared with those of sodium carbonate and potassium carbonate.

The crystalline alkali metal silicate in the present invention thus obtained has an ion exchange capacity of not less than 100 $CaCO_3$ mg/g, preferably 200 to 600 $CaCO_3$ mg/g, which is one of the material having an ion capturing ability in the present invention.

Since the crystalline alkali metal silicate having the composition (1) in the present invention has not only good alkaline capacity and alkali buffering effects but also good ion exchange capacity, the washing conditions mentioned above are suitably adjusted by adding suitable amounts of the crystalline alkali metal silicate.

In the present invention, the crystalline alkali metal silicate usable in the present invention has an average primary particle size preferably of from 0.1 to 20 $\mu$m, more preferably from 1 to 10 $\mu$m. The crystalline alkali metal silicates may be in the form of aggregates of the primary particles. When the average primary particle size of the crystalline alkali metal silicate exceeds 20 $\mu$m, the ion exchange speed thereof is likely to be slowed down, thereby resulting in the lowering of the detergency. In addition, when the average primary particle size is less than 0.1 $\mu$m, the specific surface area increases, thereby increasing the hygroscopic property and the $CO_2$ absorption property, which in turn makes it likely to cause drastic quality deterioration. Incidentally, the average particle size referred herein is a median diameter obtained from a particle size distribution, measured by using a laser scattering particle size distribution analyzer as detailed in Examples set forth below.

The crystalline alkali metal silicate having the average particle size and the particle size distribution mentioned above can be prepared by pulverizing the material using such pulverizing devices as a vibrating mill, a hammer mill, a ball-mill, and a roller mill. For instance, the crystalline alkali metal silicate can be easily obtained by pulverizing the material with a vibrating mill "HB-O" (manufactured by Chuo Kakohki Co., Ltd.).

Next, the crystalline alkali metal silicates having the composition (2) above will be explained below.

The crystalline alkali metal silicates has the general formula (III):

$$M_2O \cdot x'SiO_2 \cdot y'H_2O. \quad \text{(III)}$$

wherein M stands for an alkali metal atom, and x' and y' are numerical values satisfying x'=1.5 to 2.6 and y'=0 to 20.

Of those having the above general formula (III), x' and y' preferably satisfy $1.7 \leqq x' \leqq 2.2$ and y'=0. The crystalline alkali metal silicates have a cationic exchange capacity of from 100 to 400 $CaCO_3$ mg/g, which is one of the material having an ion capturing ability in the present invention.

In the crystalline alkali metal silicates having the composition (2) above, examples of $M_2O$ and $SiO_2$ may be the same as those listed in the crystalline alkali metal silicates having the composition (1) above.

Since the crystalline alkali metal silicate having the composition (2) in the present invention has not only good alkaline capacity and alkali buffering effects but also good ion exchange capacity, the washing conditions are suitably adjusted by adding suitable amounts of the crystalline alkali metal silicate.

The crystalline alkali metal silicates having the composition (2) may be produced by a method disclosed in Japanese Patent Laid-Open No. 60-227895, which can be generally produced by baking glassy amorphous sodium silicate at a temperature of from 200 to 1000° C. to convert to a crystalline phase. Details of the production method is disclosed in "Phys. Chem. Glasses, 7, pp.127–138 (1966), Z. Kristallogr., 129, pp.396–404(1969)." Also, the crystalline alkali metal silicates are commercially available in powdery or granular forms, for instance, under a trade name "Na-SKS-6" ($\delta$-$Na_2Si_2O_5$) (manufactured by Hoechst-Tokuyama).

In the present invention, as in the case of the crystalline alkali metal silicates having the composition (1), the crystalline alkali metal silicates having the composition (2) preferably have an average particle size of from 0.1 to 20 $\mu$m, more preferably 1 to 10 $\mu$m as measured in the same manner as the crystalline alkali metal silicates having the composition (1) mentioned above. The crystalline alkali metal silicates may also be in the form of aggregates of the primary particles.

In the present invention, the crystalline alkali metal silicates having the compositions (1) and (2) may be used alone or in combination of two or more kinds. It is preferred that the crystalline alkali metal silicates occupy 20 to 50% by weight of the entire detergent composition, preferably 20 to 35% by weight. When the crystalline alkali metal silicates occupy more than 50% by weight, the resulting detergent compositions are susceptible to lower the powder properties as well as the detergency against the sebum dirt stains. On the other hand, when the crystalline alkali metal silicates occupy less than 20% by weight, the production efficiency of the organic peracids are lowered, thereby lowering the detergency of the sebum dirt stains.

c) Metal Ion Capturing Agents Other Than Alkali Metal Silicates

The metal ion capturing agents other than the crystalline alkali metal silicates b) in the present invention refer to those having values obtained by one of the methods detailed below of not less than 100 $CaCO_3$ mg/g.

Here, the methods for measuring the ion capturing capability of the metal ion capturing materials depend upon whether the ion exchange materials or the chelating agents are used for the metal ion capturing materials. The measurement methods for each of the materials are given below.

Ion Exchange Materials

A 0.1 g sample is accurately weighed and added to 100 ml of a calcium chloride aqueous solution (500 ppm concentration, when calculated as $CaCO_3$), followed by stirring at 25° C. for 60 minutes, after which the mixture is filtered using Membrane Filter (made of nitrocellulose; manufactured by Advantech) with 0.2 $\mu$m pore size. 10 ml of the filtrate is assayed for Ca content by an EDTA titration, and the calcium ion exchange capacity (cationic exchange capacity) of the sample is calculated from the titer.

Examples of the ion exchange materials used for measurement in the present invention include inorganic substances, such as crystalline alkali metal silicates and aluminosilicates (zeolites, etc.).

Chelating Agents

The calcium ion capturing capacity was measured by the following method using a calcium ion electrode. Incidentally, the solution used herein was prepared with the following buffer solution:

Buffer: 0.1 M—$NH_4Cl$—$NH_4OH$ solution (pH 10.0)

(1) Preparation of Calibration Curve

A standard calcium ion solution is prepared and used for obtaining a calibration curve showing the relationships between the logarithm of the calcium ion concentration and the voltage, as shown in FIG. 1.

(2) Measurement of Calcium Ion Capturing Capacity

Figure 2:
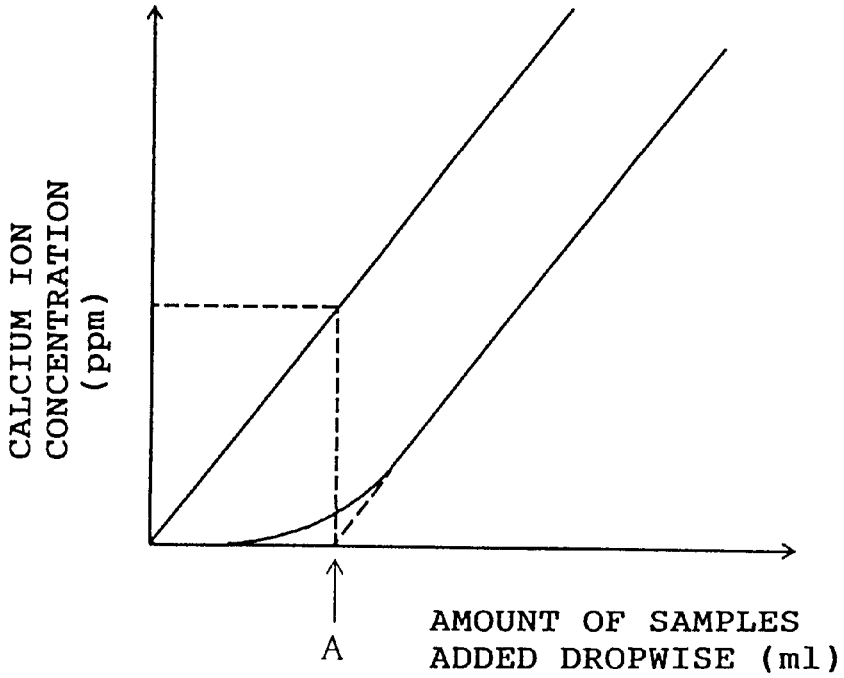
FIG. 2 is a graph showing the relationships between the amount of samples added dropwise and the calcium ion concentration.

About a 0.1 g sample is weighed into a 100 ml volumetric flask, and the volumetric flask is filled up to a volume of 100 ml with the above buffer solution. A $CaCl_2$ aqueous solution (pH 10.0) having a concentration of 20,000 ppm calculated as $CaCO_3$ is added dropwise from a burette in an amount of 0.1 to 0.2 ml for reading each sample voltage. A blank sample is also measured. Thus, a calcium ion concentration is calculated from the calibration curve given in FIG. 1 by applying a sample voltage. The calcium ion concentration of the upper line corresponding to the amount A of samples added dropwise shown in FIG. 2 is referred to as calcium ion capturing capacity. Examples of the chelating agents used for measurement in the present invention include polycarboxylates, such as citrates, and carboxylate polymers, such as acrylic acid-maleic acid copolymers.

Among the above metal ion capturing agents, a preference is given to those containing a carboxylate polymer in an amount of 1% by weight or more, the carboxylate polymer having a calcium ion capturing capacity of 200 $CaCO_3$ mg/g or more.

Examples of the above carboxylate polymer include polymers or copolymers, each having repeating units represented by the general formula (IV):

(IV)

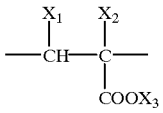

wherein $X_1$ stands for a methyl group, a hydrogen atom, or a $COOX_3$ group; $X_2$ stands for a methyl group, a hydrogen atom, or hydroxyl; $X_3$ stands for a hydrogen atom, an alkali metal atom, an alkaline earth metal atom, an ammonium atom, or ethanolamine.

In the general formula (IV), examples of the alkali metals include Na, K, and Li, and examples of the alkaline earth metals include Ca and Mg.

Examples of the polymers or copolymers usable in the present invention include those obtainable by polymerization reactions of acrylic acid, (anhydrous) maleic acid, methacrylic acid, α-hydroxyacrylic acid, crotonic acid, isocrotonic acid, and salts thereof; copolymerization reactions of each of the monomers; or copolymerization reactions of the above monomers with other polymerizable monomers. Here, examples of the copolymerizable monomers used in copolymerization reaction include aconitic acid, itaconic acid, citraconic acid, fumaric acid, vinyl phosphonic acid, sulfonated maleic acid, diisobutylene, styrene, methyl vinyl ether, ethylene, propylene, isobutylene, pentene, butadiene, isoprene, vinyl acetate (vinyl alcohols in cases where hydrolysis takes place after copolymerization), and acrylic acid ester, without particularly being limited thereto. Incidentally, the polymerization reactions are not particularly limited, and any of the conventionally known methods may be employed.

Also, polyacetal carboxylic acid polymers such as polyglyoxylic acids disclosed in Japanese Patent Laid-Open No. 54-52196 are also usable for the polymers in the present invention.

In the present invention, the above polymers and copolymers normally have a weight-average molecular weight of from 800 to 1,000,000, preferably from 5,000 to 200,000. When the weight-average molecular weight of the polymers or copolymers is less than 800, the effects of the present invention ascribed to the polymers cannot be obtained, and when the weight-average molecular weight exceeds 1,000,000, the polymers cause recontamination, thereby inhibiting the washing performance.

Also, in the case of copolymers, although the copolymerization ratio between the repeating units of the general formula (IV) and other copolymerizable monomers is not particularly limited, a preference is given to a copolymerization ratio of the repeating units of general formula (IV)/other copolymerizable monomer=1/100 to 90/10.

In addition, among the c) metal ion capturing agents other than the crystalline alkali metal silicates b) mentioned above, a greater preference is given to aluminosilicates having an ion exchange capacity of not less than 200 $CaCO_3$ mg/g and having the following formula (V):

$$x''(M_2O)\bullet Al_2O_3\bullet y''(SiO_2)\bullet w''(H_2O), \quad (V)$$

wherein M stands for an alkali metal atom, such as sodium or potassium; x", y", and w" each stands for a molar number of each component; and generally, x" is from 0.7 to 1.5; y" is from 0.8 to 6.0; and w" is an arbitrary number.

The aluminosilicates mentioned above may be crystalline or amorphous. Among the crystalline aluminosilicates, a particular preference is given to those having the following general formula:

$$Na_2O\bullet Al_2O_3\bullet ySiO_2\bullet wH_2O,$$

wherein y is a number of from 1.8 to 3.0; and w is a number of from 1 to 6.

As for the crystalline aluminosilicates (zeolites), synthetic zeolites having an average, primary particle size of from 0.1 to 10 μm, which are typically exemplified by A-type zeolite, X-type zeolite, and P-type zeolite, are suitably used. The zeolites may be used in the forms of powder, a zeolite slurry, or dried particles comprising zeolite agglomerates obtained by drying the slurry. The zeolites of the above forms may also be used in combination.

The above crystalline aluminosilicates are obtainable by conventional methods. For instance, methods disclosed in Japanese Patent Laid-Open Nos. 50-12381 and 51-12805 may be employed.

On the other hand, the amorphous aluminosilicates represented by the same general formula as the above crystalline aluminosilicate are also obtainable by conventional methods. For instance, the amorphous aluminosilicates are prepared by adding an aqueous solution of a low-alkali alkali metal aluminate having a molar ratio of $M_2O$ to $Al_2O_3$ (M standing for an alkali metal atom) of $M_2O/Al_2O_3$=1.0 to 2.0 and a molar ratio of $H_2O$ to $M_2O$ of $H_2O/M_2O$=6.0 to 500 to an aqueous solution of an alkali metal silicate having a molar ratio of $SiO_2$ to $M_2O$ of $SiO_2/M_2O$=1.0 to 4.0 and a molar ratio of $H_2O$ to $M_2O$ of $H_2O/M_2O$=12 to 200 under vigorous stirring at normally 15 to 60° C., preferably 30 to 50° C.

The intended product can be advantageously obtained by heat-treating a white slurry of precipitates thus formed at 70 to 100° C., preferably 90 to 100° C., for normally not less than 10 minutes and not more than 10 hours, preferably not more than 5 hours, followed by filtration, washing and drying. Incidentally, the aqueous solution of an alkali metal silicate may be added to the aqueous solution of a low-alkali alkali metal aluminate.

By this method, the oil-absorbing amorphous aluminosilicate carrier having an ion exchange capacity of not less than 100 $CaCO_3$ mg/g and an oil-absorbing capacity of not less than 80 ml/100 g can be easily obtained (see Japanese Patent Laid-Open Nos. 62-191417 and 62-191419).

The other metal ion capturing agents include organic chelating agents, such as aminotri(methylenephosphonic acid), 1-hydroxyethylidene-1,1-diphosphonic acid, ethylenediaminetetra(methylenephosphonic acid), diethylenetriaminepenta(methylenephosphonic acid), and salts thereof; salts of phosphonocarboxylic acids, such as salts of 2-phosphonobutane-1,2-dicarboxylic acid; citrates; aminopolyacetates, such as nitrilotriacetates and ethylenediaminetetraacetates.

Examples of other components which may be added to the detergent composition in the present invention as alkalizers include alkali metal salts, such as amorphous alkali metal silicates, alkali metal carbonates, and alkali metal sulfites, and organic amines, such as alkanolamines.

In addition, color-fading preventives, and recontamination preventives generally used for detergent compositions, including non-dissociating polymers such as polyethylene glycols, polyvinyl alcohols, and polyvinyl pyrrolidones; and carboxymethyl cellulose may be optionally used.

Besides the above, the following components may be also contained in the detergent compositions of the present invention. Specifically, the detergent compositions of the present invention may contain one or more components selected from enzymes, such as protease, lipase, cellulose, and amylase; caking preventives, such as lower alkylbenzenesulfonates whose alkyl moieties have about 1 to 4 carbon atoms, sulfosuccinates, talc, and calcium silicates; antioxidants, such as tert-butylhydroxytoluene, and distyrenated cresol; fluorescent dyes; blueing agents; and perfume, without being particularly limited thereto, to give compositions suitable for their purposes.

The detergent compositions of the present invention containing each of the components described above may be produced by any of the conventionally known methods without particular limitation. A preference is given to a method where the organic peracid precursors and the hydrogen peroxide releasing materials are separately produced in the form of powders and then the components are dry-blended so as to inhibit the lowering the bleaching activity by the reaction between the organic peracid precursors and the hydrogen peroxide releasing materials during the production process.

Examples of the methods for producing high-bulk density detergents include the methods disclosed in Japanese Patent Laid-Open Nos. 61-69897, 61-69899, 61-69900, and 5-209200.

The bleaching detergent composition of the present invention shows excellent detergency against the lipophilic dirt stains, such as sebum dirt stains and yellow stains on underwear.

EXAMPLES

The present invention will be further described by means of the following working preparation examples, examples, comparative examples, and test example, without intending to restrict the scope of the present invention thereto.

The measurements shown in Examples are obtained as follows:

(1) Amount of Materials Having Ion Capturing Capacity

The ion capturing capacity was measured by the following different methods in accordance with a case where the materials used having a metal ion capturing capacity are ion exchange materials and a case where the materials are chelating agents. Incidentally, the ion capturing capacity of the metal ion capturing agents are expressed by CEC (calcium ion exchange capacity) in Table 1 as in the same manner as in alkali metal silicates. Also, the DH water hardness was measured by ion coupling plasma method (ICP method).

Ion Exchange Materials

A 0.1 g sample was accurately weighed and added to 100 ml of a calcium chloride aqueous solution (500 ppm concentration, when calculated as $CaCO_3$), followed by stirring at 25° C. for 60 minutes, after which the mixture was filtered using Membrane Filter (made of nitrocellulose; manufactured by Advantech) with 0.2 $\mu$m pore size. 10 ml of the filtrate was assayed for Ca content by an EDTA titration, and the calcium ion exchange capacity (cationic exchange capacity) of the sample was calculated from the titer.

Chelating Agents

The calcium ion capturing capacity was measured by the following method using a calcium ion electrode. Incidentally, the solution used herein was prepared with the following buffer solution:

Buffer: 0.1 M—$NH_4Cl$-$NH_4OH$ solution (pH 10.0)

(i) Preparation of Calibration Curve

A standard calcium ion solution was prepared and used for obtaining a calibration curve showing the relationships between the logarithm of the calcium ion concentration and the voltage, as shown in FIG. 1.

(ii) Measurement of Calcium Ion Capturing Capacity

About a 0.1 g sample was weighed into a 100 ml volumetric flask, and the volumetric flask was filled up to a volume of 100 ml with the above buffer solution. A $CaCl_2$ aqueous solution (pH 10.0) having a concentration of 20,000 ppm calculated as $CaCO_3$ was added dropwise from a burette in an amount of 0.1 to 0.2 ml for reading each sample voltage. A blank sample was also measured. Thus, a calcium ion concentration was calculated from the calibration curve given in FIG. 1 by applying a sample voltage. The calcium ion concentration of the upper line corresponding to the amount A of samples added dropwise shown in FIG. 2 was referred to as calcium ion capturing capacity.

(2) Average Particle Size and Particle Size Distribution of Alkali Metal Silicates The average particle size and the particle size distribution were measured by using a laser scattering particle size distribution analyzer. Specifically, about 200 ml of ethanol was poured into a measurement cell of a laser scattering particle size distribution analyzer ("LA-700," manufactured by HORIBA Ltd.), and about a 0.5 to 5 mg sample was suspended in ethanol. Next, while irradiating ultrasonic wave, the mixture was agitated for one minute, to thereby sufficiently disperse the sample. Thereafter, an He-Ne laser beam (632.8 nm) was irradiated, and the particle size distribution was measured from the diffraction/scattering patterns. The analysis was made based on the combined theories of Fraunhofer diffraction theory and Mie scattering theory. The particle size distribution of the suspended particles in the liquid was measured in the size range of from 0.04 to 262 $\mu$m. The average particle size was a median of the particle size distribution.

Preparation Example 1

Crystalline Alkali Metal Silicates A to F

To 1000 parts by weight of No. 2 sodium silicate ($SiO_2$/$Na_2O$=2.5), 55.9 parts by weight of sodium hydroxide and 8.5 parts by weight of potassium hydroxide were added, followed by stirring using a homomixer to dissolve the sodium hydroxide and potassium hydroxide. To the above mixture, 5.23 parts by weight of finely dispersed anhydrous calcium carbonate and 0.13 parts by weight of magnesium nitrate hexahydrate were added, and the resulting mixture was mixed using a homomixer. A given amount of the mixture was transferred into a nickel crucible and baked in the air at a temperature of 700° C. for 1 hour, followed by rapid cooling. The obtained baked product was pulverized to give a crystalline alkali metal silicate powder A of the present invention. This powder had a high ion exchange capacity of 305 $CaCO_3$ mg/g.

The same procedures as above were carried out to give the crystalline alkali metal silicate powders B to F each having the composition shown in Table 1.

TABLE 1

| Crystalline Silicates | $M_2O$ | K/Na | y/x | M' O | z/x | Mg/Ca | CEC ($CaCO_3$mg/g) |
|---|---|---|---|---|---|---|---|
| A | $Na_2O$, $K_2O$ | 0.03 | 1.80 | CaO, MgO | 0.02 | 0.01 | 305 |
| B | $Na_2O$, $K_2O$ | 2.50 | 1.60 | CaO, MgO | 0.10 | 1.25 | 311 |
| C | $Na_2O$, $K_2O$ | 0.75 | 1.70 | CaO, MgO | 0.50 | 0.03 | 345 |
| D | $Na_2O$ | — | 1.50 | CaO | 0.20 | — | 303 |
| E | $Na_2O$ | — | 2.00 | — | — | — | 224 |
| F | $Na_2O$ | — | 4.00 | — | — | — | 141 |

Preparation Example 2

Amorphous Aluminosilicate

Sodium carbonate was dissolved in ion-exchanged water, to prepare an aqueous solution with 6% by weight concentration. 132 g of the above aqueous solution and 38.28 g of a sodium aluminate aqueous solution (conc. 50% by weight) were placed in a 1000-ml capacity reaction vessel equipped with baffles. 201.4 grams of a solution of No. 3 Water Glass diluted with water twice were added dropwise to the above mixed solution by under strong agitation at a temperature of 40° C. over a period of 20 minutes. Here, the reaction speed was optimized by adjusting a pH of the reaction system to a pH of 10.5 by blowing a $CO_2$ gas thereinto. Thereafter, the reaction system was heated to a temperature of 50° C. and stirred at 50° C. for 30 minutes. Subsequently, an excess alkali was neutralized by adjusting a pH of the reaction system to a pH of 9.0 by blowing a $CO_2$ gas thereinto. The obtained neutralized slurry was filtered under a reduced pressure using a filter paper (No. 5C, manufactured by Toyo Roshi Kaisha, Ltd.). The filtered cake was rinsed with water in an amount of 1000-folds, and the rinsed cake was filtered and dried under the conditions of 105° C., 300 Torr, and 10 hours. The residual portion was dried under the same conditions as above without giving any further rinsing treatments. Further, the dried cake was broken into particles, to give an amorphous aluminosilicate powder in the present invention. Incidentally, the sodium aluminate aqueous solution was prepared by the steps of adding and mixing 243 g of $Al(OH)_3$ and 298.7 g of a 48% by weight NaOH aqueous solution in a 1000 cc-capacity four-necked flask, heating the mixture to a temperature of 110° C. with stirring, and maintaining the temperature of 110° C. for 30 minutes, to dissolve the components.

As shown by the results of atomic absorption spectrophotometry and plasma emission spectrochemical analysis, the resulting amorphous aluminosilicate had the following composition: $Al_2O_3$=29.6% by weight; $SiO_2$=52.4% by weight; and $Na_2O$=18.0% by weight (1.0 $Na_2O \cdot Al_2O_3 \cdot 3.10\ SiO_2$). In addition, the calcium ion capturing capacity was 185 $CaCO_3$ mg/g, and the oil-absorbing capacity was 285 ml/100 g. The percentage of the microporous capacity having a microporous diameter of less than 0.1 μm was 9.4%, and the percentage of the microporous capacity having a microporous diameter of not less than 0.1 μm and not more than 2.0 μm was 76.3%. The water content was 11.2% by weight.

Preparation Example 3

Sodium alkanoyloxybenzenesulfonate

One-hundred grams of sodium p-phenolsulfonate which was previously dehydrated was dispersed in 300 g of dimethylformamide (hereinafter simply referred to as "DMF"), and lauroyl chloride at 50° C. was added dropwise to the above mixture over a period of 30 minutes while stirring with a magnetic stirrer. After completing the dropwise addition, the components were allowed to react with one another for 3 hours. Thereafter, the DMF was distilled off at 100° C. under a reduced pressure of 0.5 to 1 mmHg. After rinsing the resulting mixture with acetone, recrystallization was carried out in a water/acetone solvent (molar ratio 1:1), to give sodium lauroyloxybenzenesulfonate (yield 85%).

The similar procedures as above were carried out except for changing lauroyl chloride to acetyl chloride, to give a sodium alkanoyloxybenzenesulfonate (C=1).

Examples 1 to 5 and Comparative Examples 1 to 8

The crystalline alkali metal silicates A to F, the amorphous aluminosilicate, and the sodium alkanoyloxybenzenesulfonates, each obtained in the above Preparation Examples, and other components shown in Tables 2 to 4 were used to prepare the detergent compositions of the present invention having the compositions shown in Tables 2 through 4 by the method described below.

Specifically, given amounts of the aqueous components shown in Table 2 to 4, including such components as, sodium linear alkylbenzenesulfonate (LAS-Na), sodium alkyl sulfate (AS-Na), sodium polyacrylate, sodium carbonate, and sodium sulfate, were prepared as an aqueous slurry of 60% solid content, the aqueous components excluding the crystalline alkali metal silicates A to F, the amorphous aluminosilicate, the nonionic surfactants, sodium percarbonate, a bleaching activating agent (sodium alkanoyloxybenzenesulfonate), perfume, and enzyme. After spray-drying the slurry, the obtained grains were supplied into Lödige Mixer, after the remaining powder starting materials were supplied into the mixer, the mixture was subjected to mixing granulation while gradually introducing a liquid nonionic surfactant.

Incidentally, sodium percarbonate used in each of Examples and Comparative Examples were blended in granular forms.

Thus, powdery detergent compositions with an average particle size of from 300 to 600 μm, each having a bulk density of from 0.6 to 1.0 g/ml were obtained.

Test Example

The detergent compositions obtained in Examples and Comparative Examples were used to carry out a detergency test under the following conditions:

Measurement Method for Detergency Against Sebum Dirt Stains (1) Preparation of Artificially Stained Cloth An artificial staining liquid having the following compositions was adhered to prepare an artificially stained cloth. Artificial staining liquid was printed on a cloth by an engravure staining machine equipped with an engravure roll coater disclosed in Japanese Patent Laid-Open No. 7-270395. The process for adhering the artificial staining liquid to a cloth to prepare an artificially stained cloth was carried out under the conditions of a cell capacity of a gravure roll of 58 $cm^3/cm^2$, a coating speed of 1.0 m/min, a drying temperature of 100° C., and a drying time of one minute. Here, a cloth (#2003 calico, manufactured by Senshokushizai Kabushikikaisha Tanigashira Shoten) was used.

| Composition of Artificial Staining Liquid | |
|---|---|
| Lauric acid | 0.44% by weight |
| Myristic acid | 3.09% by weight |
| Pentadecanoic acid | 2.31% by weight |
| Palmitic acid | 6.18% by weight |
| Heptadecanoic acid | 0.44% by weight |
| Stearic acid | 1.57% by weight |
| Oleic acid | 7.75% by weight |
| Triolein | 13.06% by weight |
| n-Hexadecyl palmitate | 2.18% by weight |
| Squalane | 6.53% by weight |
| Egg white lecithin crystalline liquid | 1.94% by weight |
| Kanuma sekigyoku soil | 8.11% by weight |
| Carbon black | 0.01% by weight |
| Tap water | Balance |

(2) Detergency Conditions

Washing of the above-mentioned artificially stained cloth in 4° DH water (Ca/Mg=3/1) was carried out by using Turgotometer at a rotational speed of 100 rpm, at a temperature of 20° C. for 10 minutes, in which each of the detergent compositions given in Tables 2 to 4 was used in a concentration of 0.67 g/liter.

Incidentally, the typical water hardness components in the water for washing are $Ca^{2+}$ and $Mg^{2+}$, whose weight ratios are generally in the range of Ca/Mg=(60–85)/(40–15). Here, a model sample of water of Ca/Mg=3/1 was used. The unit "4° DH" refers to a water hardness which was calculated by replacing Mg with Ca.

(3) Calculation of Detergency Rate

Reflectivities of the original cloth and those of the stained cloth before and after washing were measured at 550 mμ by means of an automatic recording colorimeter (manufactured by Shimadzu Corporation), and the detergency rate D (%) was calculated by the following equation. The results thereof are shown in Tables 2 to 4.

$$D = \frac{(L_2 - L_1)}{(L_0 - L_1)} \times 100(\%),$$

wherein $L_0$: Reflectivity of the original cloth;

$L_1$: Reflectivity of the stained cloth before washing; and $L_2$: Reflectivity of the stained cloth after washing.

Measurement Method for Detergency Against Yellowish Stains (1) Preparation of Model Yellowish Stained Underwear Linoleic acid and squalane in a weight ratio of 1:10, the components considered to form yellowish stains, were dispersed and dissolved chloroform so as to give a concentration of 10% by weight.

This solution was added dropwise in an amount of 0.6 ml per sheet of a 8 cm×8 cm cotton cloth (cotton calico #2003), and then the chloroform diffused on the cloth was evaporated. Thereafter, the cotton cloth was subjected to aging in a thermostat at 50° C. The cotton cloth with "b" values of 3 or more was used as a typical yellowish stained cloth.

(2) Detergency Bleaching Test

Washing of four sheets of the artificially stained cloths used as one set, each sheet being obtained by the above method, were carried out by using Turgotometer (manufactured by Shimadzu Corporation).

The washing conditions were as follows:

| | |
|---|---|
| Washing time: | 10 minutes, rinsing 3 minutes (tap water). |
| Rotational speed: | 100 rpm. |
| Water hardness: | 4° DH. |
| Temperature: | 20° C. |
| Concentration: | 0.67 g/liter. |

(3) Calculation of Bleaching Detergency Rate

Reflectivities of the original cloth and those of the stained cloth before and after washing were measured using a filter at a wavelength of 460 nm ("NDR-101DP," manufactured by Nippon Denshoku Kogyo Kabushiki Kaisha), and the bleaching detergency rate D (%) for yellowish stains was calculated by the following equation. The results thereof are shown in Tables 2 to 4.

$$D = \frac{(L_2 - L_1)}{(L_0 - L_1)} \times 100(\%),$$

wherein $L_0$: Reflectivity of the original cloth;

$L_1$: Reflectivity of the stained cloth before washing; and $L_2$: Reflectivity of the stained cloth after washing.

TABLE 2

| | Example 1 (% by wt.) | Example 2 (% by wt.) | Example 3 (% by wt.) | Example 4 (% by wt.) | Example 5 (% by wt.) |
|---|---|---|---|---|---|
| (a) LAS—Na (C12) | 0.00 | 0.00 | 1.25 | 0.00 | 0.00 |
| AS—Na (C14–15) | 0.00 | 3.75 | 0.00 | 1.25 | 0.00 |
| Soap (C12–20) | 3.75 | 5.00 | 2.50 | 5.00 | 2.50 |
| Nonionic Surfactant (C12–14) | 17.50 | 15.00 | 20.00 | 15.00 | 15.00 |
| (b) Crystalline Silicate A | 37.50 | 0.00 | 0.00 | 9.00 | 0.00 |
| Crystalline Silicate B | 0.00 | 25.00 | 0.00 | 0.00 | 0.00 |
| Crystalline Silicate C | 0.00 | 0.00 | 31.25 | 0.00 | 0.00 |
| Crystalline Silicate D | 0.00 | 0.00 | 0.00 | 22.50 | 0.00 |
| Crystalline Silicate E | 0.00 | 0.00 | 0.00 | 0.00 | 20.00 |
| Crystalline Silicate F | 0.00 | 0.00 | 0.00 | 0.00 | 0.00 |
| (c) AA/MA Copolymer | 5.00 | 6.25 | 0.00 | 6.25 | 6.25 |
| Zeolite | 12.50 | 16.25 | 15.00 | 22.50 | 31.25 |
| Amorphous Aluminosilicate | 5.00 | 8.75 | 8.75 | 7.50 | 6.25 |
| Sodium Polyacrylate | 0.00 | 0.00 | 3.75 | 0.00 | 0.00 |
| Sodium Carbonate | 0.00 | 2.50 | 0.00 | 0.00 | 6.25 |
| Sodium Silicate (JIS No.2) | 0.00 | 0.00 | 0.00 | 0.00 | 0.00 |
| Sodium Alkanoyloxybenzenesulfonate (R = $C_{11}$) | 6.25 | 6.25 | 3.00 | 6.25 | 3.75 |
| Sodium Alkanoyloxybenzenesulfonate (R = $C_1$) | 0.00 | 0.00 | 0.00 | 0.00 | 0.00 |
| Sodium Percarbonate | 6.25 | 6.25 | 6.00 | 6.25 | 6.25 |
| Sodium Sulfate | 3.75 | 2.50 | 3.75 | 3.75 | 0.00 |
| Polyethylene Glycol (ave. Mw 13000) | 0.00 | 0.00 | 0.00 | 1.25 | 0.00 |
| Other Components | 2.50 | 2.50 | 4.75 | 2.50 | 2.50 |
| Total Amount | 100.00 | 100.00 | 100.00 | 100.00 | 100.00 |
| (a) + (b) + (c) = | 81.25 | 80.00 | 82.50 | 80.00 | 81.25 |
| Organic Peracid Precursor/Nonionic Surfactant | 0.36 | 0.42 | 0.15 | 0.42 | 0.25 |
| Detergency Against Sebum Dirt Stains (%) | 76.2 | 73.2 | 75.8 | 72.3 | 70.2 |
| Detergency Against Yellowish Stains (%) | 43.6 | 41.9 | 38.5 | 40.7 | 39.6 |

TABLE 3

| | Comparative Example (% by wt.) | Comparative Example 2 (% by wt.) | Comparative Example 3 (% by wt.) | Comparative Example 4 (% by wt.) | Comparative Example 5 (% by wt.) |
|---|---|---|---|---|---|
| (a) LAS—Na (C12) | 0.00 | 0.00 | 0.00 | 25.00 | 0.00 |
| AS—Na (C14–15) | 0.00 | 0.00 | 3.75 | 10.50 | 1.25 |
| Soap (C12–20) | 3.75 | 3.75 | 5.00 | 2.50 | 5.00 |
| Nonionic Surfactant (C12–14) | 17.50 | 17.50 | 15.00 | 2.50 | 15.00 |
| (b) Crystalline Silicate A | 37.50 | 0.00 | 10.00 | 20.00 | 15.00 |
| Crystalline Silicate B | 0.00 | 0.00. | 0.00 | 0.00 | 0.00 |
| Crystalline Silicate C | 0.00 | 0.00 | 0.00 | 0.00 | 0.00 |
| Crystalline Silicate D | 0.00 | 0.00 | 0.00 | 0.00 | 0.00 |
| Crystalline Silicate E | 0.00 | 0.00 | 0.00 | 0.00 | 0.00 |
| Crystalline Silicate F | 0.00 | 37.50 | 0.00 | 0.00 | 0.00 |
| (c) AA/MA Copolymer | 5.00 | 5.00 | 6.25 | 2.50 | 6.25 |
| Zeolite | 12.50 | 12.50 | 15.00 | 12.50 | 12.50 |
| Amorphous Aluminosilicate | 5.00 | 5.00 | 8.75 | 0.00 | 7.50 |
| Sodium Polyacrylate | 0.00 | 0.00 | 0.00 | 2.50 | 0.00 |
| Sodium Carbonate | 0.00 | 0.00 | 12.50 | 0.00 | 10.00 |
| Sodium Silicate (JIS No. 2) | 0.00 | 0.00 | 5.00 | 3.00 | 0.00 |
| Sodium Alkanoyloxybenzenesulfonate (R = $C_{11}$) | 0.00 | 6.25 | 6.25 | 4.50 | 6.25 |
| Sodium Alkanoyloxybenzenesulfonate (R = $C_1$) | 6.25 | 0.00 | 0.00 | 0.00 | 0.00 |
| Sodium Percarbonate | 6.25 | 6.25 | 6.25 | 6.00 | 12.50 |
| Sodium Sulfate | 3.75 | 3.75 | 3.75 | 3.00 | 5.00 |
| Polyethylene Glycol (ave. Mw 13000) | 0.00 | 0.00 | 0.00 | 3.00 | 1.25 |
| Other Components | 2.50 | 2.50 | 2.50 | 2.50 | 2.50 |
| Total Amount | 100.00 | 100.00 | 100.00 | 100.00 | 100.00 |
| (a) + (b) + (c) = | 81.25 | 81.25 | 63.75 | 78.00 | 62.50 |
| Organic Peracid Precursor/Nonionic Surfactant | 0.36 | 0.36 | 0.42 | 1.80 | 0.42 |
| Detergency Against Sebum Dirt Stains (%) | 68.3 | 65.1 | 56.2 | 60.1 | 58.1 |
| Detergency Against Yellowish Stains (%) | 21.3 | 28.2 | 27.6 | 29.8 | 24.3 |

TABLE 4

| | Comparative Example 6 (% by wt.) | Comparative Example 7 (% by wt.) | Comparative Example 8 (% by wt.) |
|---|---|---|---|
| (a) LAS—Na (C12) | 0.00 | 0.00 | 0.00 |
| AS—Na (C14–15) | 0.00 | 0.00 | 0.00 |
| Soap (C12–20) | 2.50 | 2.50 | 0.00 |
| Nonionic Surfactant (C12–14) | 30.00 | 15.00 | 2.50 |
| (b) Crystalline Silicate A | 20.00 | 60.00 | 27.50 |
| Crystalline Silicate B | 0.00 | 0.00 | 0.00 |
| Crystalline Silicate C | 0.00 | 0.00 | 0.00 |
| Crystalline Silicate D | 0.00 | 0.00 | 0.00 |
| Crystalline Silicate E | 0.00 | 0.00 | 0.00 |
| Crystalline Silicate F | 0.00 | 0.00 | 0.00 |
| (c) AA/MA Copolymer | 6.25 | 0.00 | 5.00 |
| Zeolite | 15.00 | 6.25 | 30.00 |
| Amorphous Aluminosilicate | 10.00 | 2.50 | 1.25 |
| Sodium Polyacrylate | 0.00 | 0.00 | 0.00 |
| Sodium Carbonate | 0.00 | 0.00 | 5.00 |
| Sodium Silicate (JIS No. 2) | 6.25 | 0.00 | 5.00 |
| Sodium Alkanoyloxybenzenesulfonate (R = $C_{11}$) | 3.00 | 0.00 | 0.00 |
| Sodium Alkanoyloxybenzenesulfonate (R = $C_1$) | 0.00 | 3.00 | 7.50 |
| Sodium Percarbonate | 6.00 | 6.00 | 10.00 |
| Sodium Sulfate | 0.00 | 3.75 | 3.75 |
| Polyethylene Glycol (ave. Mw 13000) | 0.00 | 0.00 | 0.00 |
| Other Components | 1.00 | 1.00 | 2.50 |
| Total Amount | 100.00 | 100.00 | 100.00 |
| (a) + (b) + (c) = | 83.75 | 86.25 | 66.25 |
| Organic Peracid Precursor/Nonionic Surfactant | 0.10 | 0.20 | 3.00 |
| Detergency Against Sebum Dirt Stains (%) | 67.5 | 60.1 | 50.2 |
| Detergency Against Yellowish Stains (%) | 20.5 | 20.6 | 24.5 |

Incidentally, the abbreviations and materials shown in Tables 2 to 4 are as follows:

POE: Average molar number of ethylene oxide;

LAS-Na: Sodium linear alkylbenzenesulfonate;

AS-Na : Sodium alkyl sulfate;

Nonionic surfactant: Polyethylene alkyl ether, the average molar number of ethylene oxide being 8;

Zeolite: 4A type zeolite having an average particle size of 3 $\mu$m;

AA/MA copolymer: Sodium salt of acrylic acid-maleic acid copolymer a copolymer formed by acrylic acid monomers and maleic acid monomers (acrylic acid: maleic acid=70:30), weight-average molecular weight of 70,000, and a neutralization degree of about 80%;

Amorphous Aluminosilicate: Obtained in Preparation Example 2;

Sodium polyacrylate: Polymer of sodium acrylate, average molecular weight of 10,000, and a neutralization degree of about 80%;

Other components:

Enzymes (protease and cellulase are used in combination);

Perfumes (those disclosed in Japanese Patent Laid-Open No. 5-202387, the disclosure of which is herein incorporated by reference into the present invention);

Fluorescent dyes (biphenyl and stilbene-type are used in combination); and

Water.

As shown above, all of Examples of the present invention showed high detergency against the sebum dirt stains and against the yellowish stains. By contrast, in each of Comparative Examples, the detergency against the sebum dirt stains and the detergency against the yellowish stains were notably poorer than those of Examples. Here, in the case of Comparative Example 1, the number of carbon atoms of the organic peracid was too small; in the case of Comparative Example 2, the crystalline alkali metal silicate had an excessively large $SiO_2/M_2O$ ratio; in the cases of Comparative Examples 3 and 5, the total amounts of a), b), and c) components were too large; in the case of Comparative Example 4, the detergent composition used was anionic surfactant-based; in the case of Comparative Example 6, the proportion of the organic peracid precursor based on the nonionic surfactant was too large; in the case of Comparative Example 7, the amount of the crystalline alkali metal silicate was too small; and in the case of Comparative Example 8, the amount of the surfactant was too small.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bleaching detergent composition in a form of granules or powders containing an organic peracid precursor which produces an organic peracid upon reaction with hydrogen peroxide in water, the organic peracid having an alkyl group with 7 to 19 carbon atoms, and a hydrogen peroxide releasing material, wherein the bleaching detergent composition comprises the following components a) to c):

a) one or more surfactants, including at least one nonionic surfactant;

b) one or more crystalline alkali metal silicates having an $SiO_2/M_2O$ ratio of from 0.5 to 2.6, wherein M is an alkali metal atom; and c) one or more agents for capturing metal ions other than the crystalline alkali metal silicates b), wherein a total amount of the above a), b), and c) components in the bleaching detergent composition occupies from 70 to 99% by weight, and wherein the weight ratio of component b) to component a) is b/a=90/10 to 45/55, and the weight ratio of component b) to component c) is b/c=7/93 to 75/25, and wherein the weight ratio of the organic peracid precursor to said at least one nonionic surfactant in component a) is from 15/85 to 50/50, and wherein the amount of said at least one nonionic surfactant is 70 to 100 % by weight of the entire surfactant component a).

2. The bleaching detergent composition according to claim 1, wherein said organic peracid produced is a peroxy fatty acid having a linear alkyl group with 7 to 19 carbon atoms.

3. The bleaching detergent composition according to claim 2, wherein said organic peracid precursor has the general formula (I):

(I)

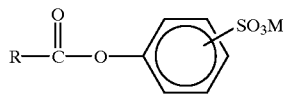

wherein R stands for a linear alkyl group or linear alkylene group, each having 7 to 19 carbon atoms; and M stands for an alkali metal atom.

4. The bleaching detergent composition according to claim 1, wherein said component a) is a polyoxyethylene alkyl ether which is an ethylene oxide adduct of a linear alcohol having 10 to 18 carbon atoms, the ethylene oxide adduct having an average molar amount of 5 to 15.

5. The bleaching detergent composition according to claim 1, wherein said crystalline alkali metal silicates have the general formula (II):

$$xM_2O \cdot ySiO_2 \cdot zMe_mO_n \cdot wH_2O \quad \text{(II)}$$

wherein M stands for one or more elements in Ia Group of the Periodic Table; Me stands for one or more elements in Group IIa, Ilb, IIIa, IVa, or VIII of the Periodic Table, and wherein x, y, z, n, m, and w are numerical values satisfying the following relationships: y/x=0.5 to 2.6, z/x=0.01 to 1.0, n/m=0.5 to 2.0, and w=0 to 20.

6. The bleaching detergent composition according to claim 1, wherein said crystalline alkali metal silicates have the general formula (III):

$$M_2O \cdot x'SiO_2 \cdot y'H_2O, \quad \text{(III)}$$

wherein M stands for an alkali metal atom, and x' and y' are numerical values satisfying x'=1.5 to 2.6 and y'=0 to 20.

7. The bleaching detergent composition according to claim 1, wherein the amount of said crystalline alkali metal silicates is from 20 to 50% by weight.

8. The bleaching detergent composition according to claim 1, wherein said hydrogen peroxide releasing material is in the form of granules or powders having an effective oxygen concentration of from 5 to 15%, and wherein said hydrogen peroxide releasing material is contained in the bleaching detergent composition in an amount of 0.5 to 15% by weight.

9. The bleaching detergent composition according to claim 1, wherein said hydrogen peroxide releasing material is sodium percarbonate.

10. The bleaching detergent composition according to claim 1, wherein the surfactant concentration is from 0.07 to 0.17 g/L when the bleaching detergent composition is added to water for washing in a standard amount of dosage.

11. The bleaching detergent composition according to claim 1, wherein component a) comprises 17.5 to about 24 wt % of the composition, component b) comprises 20 to 37.5 wt % of the composition and component c) comprises about 22.25 to 43.75 wt % of the composition.

12. The bleaching detergent composition according to claim 1, wherein the nonionic surfactant component comprises 70 to about 85 wt % of component a).

13. The bleaching detergent composition according to claim 11, wherein the nonionic surfactant component comprises 70 to about 85% of component a).

* * * * *